US008714999B1

(12) United States Patent
Wu

(10) Patent No.: US 8,714,999 B1
(45) Date of Patent: May 6, 2014

(54) VEHICLE TRANSMISSION AND CHARGE DEVICE

(71) Applicant: Sung-Chiang Wu, New Taipei (TW)

(72) Inventor: Sung-Chiang Wu, New Taipei (TW)

( * ) Notice: Subject to any disclaimer, the term of this patent is extended or adjusted under 35 U.S.C. 154(b) by 49 days.

(21) Appl. No.: 13/653,384

(22) Filed: Oct. 16, 2012

(51) Int. Cl.
*H01R 11/00* (2006.01)

(52) U.S. Cl.
USPC ..... 439/502

(58) Field of Classification Search
USPC ..... 439/500–504, 638, 668, 491, 131, 652, 439/620.21
See application file for complete search history.

(56) References Cited

U.S. PATENT DOCUMENTS 7,377,805 B2 * 5/2008 Kim et al. ..... 439/502
7,597,570 B2 * 10/2009 So ..... 439/172
7,633,023 B1 * 12/2009 Cappa et al. ..... 200/51.06
8,109,792 B2 * 2/2012 Briano et al. ..... 439/620.21
8,376,782 B2 * 2/2013 Govekar ..... 439/652
8,491,317 B2 * 7/2013 Vardanyan ..... 439/131

* cited by examiner

*Primary Examiner* — Jean F Duverne
(74) *Attorney, Agent, or Firm* — Leong C. Lei

(57) ABSTRACT

The vehicle transmission and charge device contains a casing, a power conversion module, a cable winding device, and at least a transmission cable. The casing has a number of openings and an axle, and a tongue piece. The power conversion module is inside the casing and contains a transformer module, a power input connector, and a power plug. The cable winding device is inside the casing and contains a wheel base, an elastic element, and a winding module. The winding module contains a power output connector and a circuit board. The transmission cable has one end electrically connected to the winding module and the other end connected to a head piece after running through an opening of the casing. A cigarette lighter plug is connected to the power input connector, and then plugged into a cigarette lighter receptacle of a vehicle.

9 Claims, 4 Drawing Sheets

VEHICLE TRANSMISSION AND CHARGE DEVICE

TECHNICAL FIELD OF THE INVENTION

The present invention generally relates to a transmission and charge device, and especially relates to a transmission and charge device that can be conveniently carried and used on a vehicle.

DESCRIPTION OF THE PRIOR ART

A charge device is an indispensable accessory for portable electronic devices. However, different portable electronic devices require different types of connectors so as to hook up the charge device. In addition, most of the charge devices cannot be used on an automobile or other vehicle. This is rather inconvenient for people spending some significant amount of time on driving.

In order to overcome these shortcomings, the present invention teaches a novel vehicle transmission and charge device that can be conveniently carried and used on a vehicle.

SUMMARY OF THE INVENTION

The vehicle transmission and charge device contains a casing, a power conversion module, a cable winding device, and at least a transmission cable. The casing has a number of openings and has an upper cover, a base, a lower cover, an axle, and a tongue piece, where the base is joined to and sandwiched between the upper and lower covers, the axle is inside the casing, and the tongue piece is on the base. The power conversion module is inside the casing and contains a transformer module, a power input connector, and a power plug where the power input connector and the power plug are extended outside the casing.

The cable winding device is inside the casing and contains a wheel base which is a ring-shaped piece having a trough along its circumference and a circular indentation in the center, an elastic element embedded in the circular indentation with an end joined to the axle and the other end fixed to the wheel base, and a winding module comprising a power output connector and a circuit board where the circuit board is electrically connected to the power conversion module through a cable running through the axle, the circuit board is positioned on the wheel base, and the power output connector is exposed outside the casing. The transmission cable with one end electrically connected to the winding module after winding around the trough of the wheel base and the other end connected to a head piece after running through an opening of the casing.

The power input connector is connected to a cigarette lighter plug having a positive contact at one end and a negative spring at a side where the cigarette lighter plug is connected to the power input connector, the cigarette lighter plug is capable of being plugged into a cigarette lighter receptacle of a vehicle; and the power output connector, the power plug, and the head piece are used to connect to electronic devices.

Preferably, the openings on the casing contain a cable opening, a cap opening, a connector opening, and at least a plug hole.

Preferably, the power plug is exposed through the plug holes; and the power output connector is exposed through the connector opening.

Preferably, the cigarette lighter plug has a fastening element so that the cigarette lighter plug is securely connected and locked to the power input connector.

Preferably, the axle runs through a through hole of the circular indentation; and, on a side of the base that is adjacent to the wheel base, the tongue piece and a track are configured.

Preferably, the cable winding device has a rotational cap configured between the upper cover and the wheel base; and the cap is exposed out of the cap opening of the upper cover.

Preferably, in the circular indentation, there is a ring piece partitioning the elastic element and the winding module so as to prevent their rubbing against each other.

Preferably, the power plug of the power conversion module is foldable and capable of being concealed in the plug openings on the lower cover; and the power plug is electrically connected to the transformer module.

Preferably, the power input connector; the head piece, and the power output connector are capable of being connected to one of a USB connector, a Mini USB connector, a HDMI connector, and a tablet computer connector.

With the present invention, a user can choose an appropriate interface for charging a portable electronic device, can connect a portable electronic device at a distance through the winding transmission cable, and can use the charged portable electronic device for an extended period of time.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
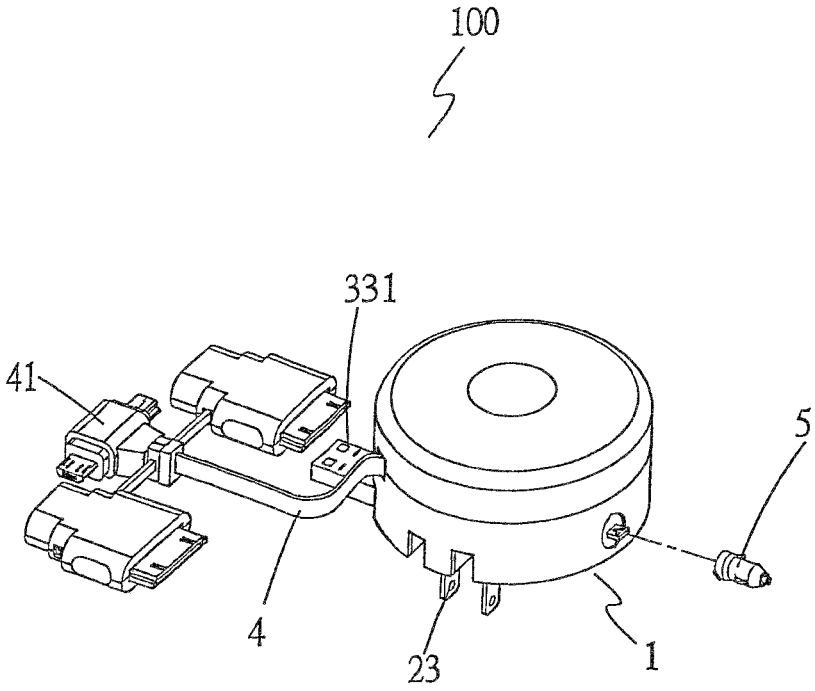
FIG. 1 is a perspective diagram showing a vehicle transmission and charge device according to an embodiment of the present invention.
Figure 2:
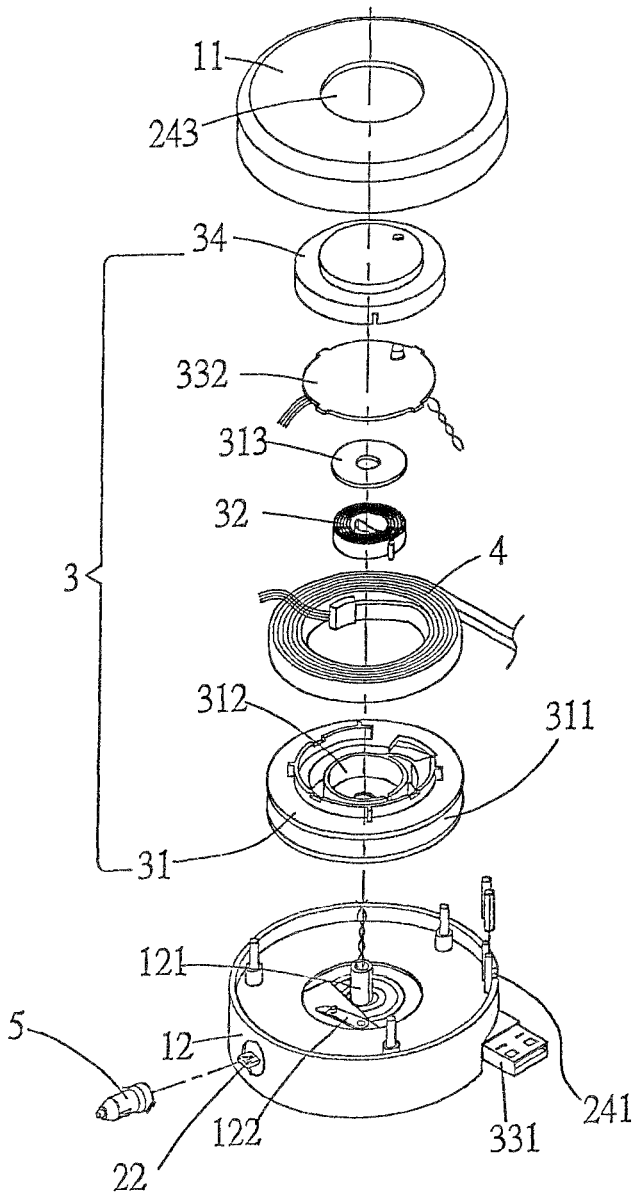
FIG. 2 is a perspective break-down diagram showing a part of the components of the vehicle transmission and charge device of FIG. 1.
Figure 3:
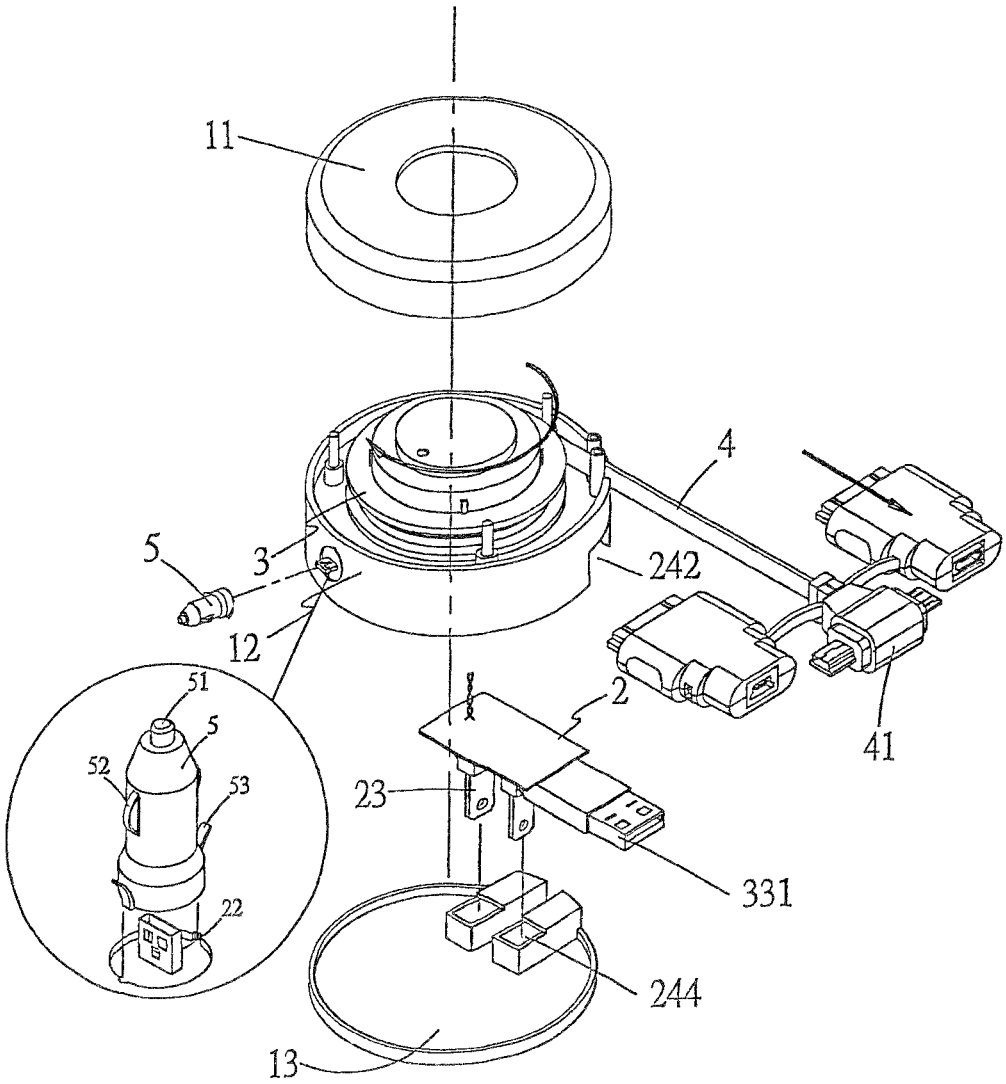
FIG. 3 is another perspective break-down diagram showing a part of the components of the vehicle transmission and charge device of FIG. 1.
Figure 4:
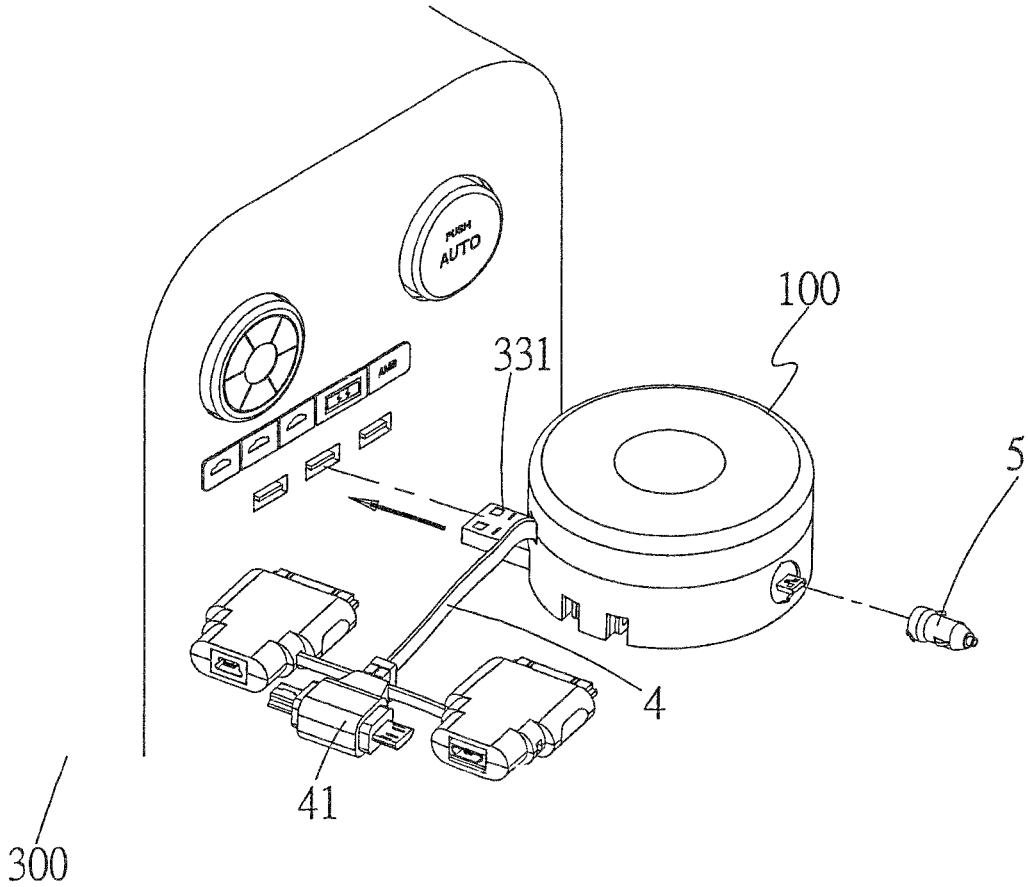
FIG. 4 is a perspective diagram showing an application of the vehicle transmission and charge device of FIG. 1.

As shown in FIGS. 1 to 4, a vehicle transmission and charge device 100 according to an embodiment of the present invention contains a casing 1 having a number of openings.

The casing 1 further contains an upper cover 11, a base 12, and a lower cover 13. The base 12 is joined to and sandwiched between the upper and lower covers 11 and 13. The base 12 contains a hollow axle 121, a tongue piece 122, and a power conversion module 2, all inside the casing 1. The power conversion module 2 contains a transformer module 21, a power input connector 22, and a power plug 23. The power input connector 22 and the power plug 23 are extended outside the casing 1. The openings on the casing 1 contain a cable opening 241, a cap opening 243, a connector opening 242, at least a plug hole 244.

A cable winding device 3 inside the casing 1 contains a wheel base 31 which is a ring-shaped piece having a trough 311 along its circumference and a circular indentation 312 in the center. The cable winding device 3 further has an elastic element 32 embedded in the circular indentation 312 with an end joined to the axle 121 and the other end fixed to the wheel base 31. The cable winding device 3 further has a winding module 33 containing a power output connector 331 and a circuit board 332. The circuit board 332 is electrically connected to the power conversion module 2 through a cable miming through the axle 121, and is positioned on the wheel base 31. The cable winding device 3 also contains a transmission cable with one end electrically connected to the winding module 33 after winding around the trough 311 of the wheel base 31 and the other end connected to a head piece 41 after running through the cable opening 241.

The gist of the present invention lies in that the power input connector 22 is connected to a cigarette lighter plug 5 having a positive contact 51 at one end and a negative spring 52 at a side. The cigarette lighter plug 5 can be plugged into an ordinary cigarette lighter receptacle. Then the vehicle transmission and charge device 100 can be used to connect to another electronic device.

In a preferred embodiment of the present invention, the cigarette lighter plug 5 has a fastening element 53 so that the cigarette lighter plug 5 can be securely connected and locked to the power input connector 22. The power plug 23 is exposed through the plug holes 244. The power output connector 331 is exposed through the connector opening 242. The axle 121 runs through a through hole of the circular indentation 312. On a side of the base 2 that is adjacent to the wheel base 31, the tongue piece 122 and a track are configured.

The cable winding device 3 has a rotational cap 34 configured between the upper cover 11 and the wheel base 31. The cap 34 is exposed out of the cap opening 243 of the upper cover 12. In the circular indentation 312, there is a ring piece 313 for partitioning the elastic element 32 and the winding module 33 so as to prevent their rubbing against each other.

The power plug 23 of the power conversion module 2 is foldable and can be concealed in the plug openings 244 on the lower cover 13. The power plug 23 is electrically connected to the transformer module 21. The power input connector 22, the head piece 31, and the power output connector 331 can be connected to a USB connector, a Mini USB connector, a HDMI connector, or a tablet computer connector.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A vehicle transmission and charge device, comprising a casing with a plurality of openings having an upper cover, a base, a lower cover, an axle, and a tongue piece, where the base is joined to and sandwiched between the upper and lower covers, the axle is inside the casing, and the tongue piece is on the base;

a power conversion module inside the casing comprising a transformer module, a power input connector, and a power plug where the power input connector and the power plug are extended outside the casing;

a cable winding device inside the casing comprising a wheel base which is a ring-shaped piece having a trough along its circumference and a circular indentation in the center, an elastic element embedded in the circular indentation with an end joined to the axle and the other end fixed to the wheel base, and a winding module comprising a power output connector and a circuit board where the circuit board is electrically connected to the power conversion module through a cable running through the axle, the circuit board is positioned on the wheel base, and the power output connector is exposed outside the casing;

a transmission cable with one end electrically connected to the winding module after winding around the trough of the wheel base and the other end connected to a head piece after running through an opening of the casing; and a cigarette lighter plug having a positive contact at one end and a negative spring at a side where the cigarette lighter plug is connected to the power input connector, the cigarette lighter plug is capable of being plugged into a cigarette lighter receptacle of a vehicle; and the power output connector, the power plug, and the head piece are used to connect to electronic devices.

2. The vehicle transmission and charge device according to claim 1, wherein the openings on the casing comprising a cable opening, a cap opening, a connector opening, and at least a plug hole.

3. The vehicle transmission and charge device according to claim 2, wherein the power plug is exposed through the plug holes; and the power output connector is exposed through the connector opening.

4. The vehicle transmission and charge device according to claim 1, wherein the cigarette lighter plug has a fastening element so that the cigarette lighter plug is securely connected and locked to the power input connector.

5. The vehicle transmission and charge device according to claim 1, wherein the axle runs through a through hole of the circular indentation; and, on a side of the base that is adjacent to the wheel base, the tongue piece and a track are configured.

6. The vehicle transmission and charge device according to claim 1, wherein the cable winding device has a rotational cap configured between the upper cover and the wheel base; and the cap is exposed out of the cap opening of the upper cover.

7. The vehicle transmission and charge device according to claim 1, wherein, in the circular indentation, there is a ring piece partitioning the elastic element and the winding module so as to prevent their rubbing against each other.

8. The vehicle transmission and charge device according to claim 1, wherein the power plug of the power conversion module is foldable and capable of being concealed in the plug openings on the lower cover; and the power plug is electrically connected to the transformer module.

9. The vehicle transmission and charge device according to claim 1, wherein the power input connector, the head piece, and the power output connector are capable of being connected to one of a USB connector, a Mini USB connector, a HDMI connector, and a tablet computer connector.

* * * * *